US008181923B2

(12) United States Patent
Verdelli, Jr.

(10) Patent No.: US 8,181,923 B2
(45) Date of Patent: May 22, 2012

(54) COMBINATION OF FURNITURE FOOT COVER AND SLIDING DEVICE

(76) Inventor: Angelo P. Verdelli, Jr., South Portland, ME (US)

( * ) Notice: Subject to any disclaimer, the term of this patent is extended or adjusted under 35 U.S.C. 154(b) by 519 days.

(21) Appl. No.: 12/006,633

(22) Filed: Jan. 4, 2008

(65) Prior Publication Data

US 2008/0179471 A1 Jul. 31, 2008

Related U.S. Application Data

(60) Provisional application No. 60/886,962, filed on Jan. 29, 2007.

(51) Int. Cl.
*A47B 91/00* (2006.01)
*F16M 11/20* (2006.01)

(52) U.S. Cl. ..... 248/188.9; 248/188.8; 248/346.11; 16/42 R; 16/42 T

(58) Field of Classification Search ..... 248/188.8, 248/188.9, 544, 346.11, 677, 345.1; 16/42 R, 16/42 T, 43, 30; 182/108, 214, 221; 297/463.1, 297/463.2

See application file for complete search history.

(56) References Cited

U.S. PATENT DOCUMENTS

| | | | | |
|---|---|---|---|---|
| D166,618 | S | 4/1952 | Mince | |
| 3,993,163 | A * | 11/1976 | Barrett | 182/108 |
| 5,426,818 | A * | 6/1995 | Bushey | 16/42 R |
| 5,945,178 | A * | 8/1999 | Volkmann | 248/188 |
| 6,405,982 | B2 * | 6/2002 | Ferencz | 248/188.9 |
| 6,647,589 | B1 * | 11/2003 | Youngwith | 248/345.1 |
| 7,124,986 | B1 | 10/2006 | Bailey | |
| 7,234,199 | B2 * | 6/2007 | Bushey | 248/188.8 |
| 7,404,232 | B2 * | 7/2008 | Chase | 248/188.9 |
| 2004/0123421 | A1 * | 7/2004 | Bushey | 16/17.1 |
| 2006/0038095 | A1 | 2/2006 | Deaner | |
| 2008/0209686 | A1 * | 9/2008 | Lang | 16/42 T |

* cited by examiner

*Primary Examiner* — Tan Le
(74) *Attorney, Agent, or Firm* — James Ray & Assoc

(57) ABSTRACT

A combination furniture foot cover and sliding device includes a housing member for covering a foot of a piece of furniture, such housing member being manufactured from a first predetermined material and having a predetermined size and a predetermined shape. A securing means is operably connected to such housing member for securing such housing member to such foot. At least one layer of a second predetermined material is operably connected to such housing member and securable with a bottom surface of such foot for enabling such foot to slide easily along a floor.

8 Claims, 1 Drawing Sheet

COMBINATION OF FURNITURE FOOT COVER AND SLIDING DEVICE

CROSS REFERENCE TO RELATED APPLICATION

This patent application is related to and claims priority from U.S. Provisional Patent Application Ser. No. 60/886,962 filed Jan. 29, 2007.

FIELD OF THE INVENTION

The present invention relates, in general, to accessories for furniture and, more particularly, this invention relates to accessories for furniture feet and sliding mechanisms for furniture.

BACKGROUND OF THE INVENTION

Prior to the conception and development of the present invention, furniture leg covers, as are generally well known in the prior art, have been used to cover the legs of furniture. Additionally, furniture sliders have been used by movers to move furniture. However, there exists no combination of the two. Furthermore, there exists no combination of the two that are pleasing to the eye such that they could be left on furniture at all times.

Specifically of interest to the present invention are the following: Bailey, U.S. Pat. No. 7,124,986, provides a protective cover for use on the bottom of chair and table legs. The invention device includes an elastomeric sleeve or cup having a bottom to which is connected a disk of soft, dense and durable protective materials such as felt.

Ferencz, U.S. Pat. No. 6,405,982 discloses a sliding support for articles of furniture, that can be attached to the article without the need for a separate fastener.

Volkmann, U.S. Pat. No. 5,945,178 discloses a furniture foot cover device and its method of manufacture wherein a primary hollow resilient sphere is provided with an opening to receive the lower portion of a furniture foot.

Mince, U.S. Patent No. DES 166,618, discloses the ornamental design for a post mitt for chairs and other furniture.

Deaner, Pub. No. 2006/0038095, discloses a floor protector for protecting a floor surface from marring by a furniture leg.

SUMMARY OF THE INVENTION

The present invention provides a combination furniture foot cover and sliding device. Such combination furniture foot cover and sliding device includes a housing member for covering a foot of a piece of furniture. Such housing member is manufactured from a first predetermined material and has a predetermined size and a predetermined shape. A securing means is operably connected to such housing member for securing such housing member to such foot. At least one layer of a second predetermined material is operably connected to a housing member and securable with a bottom surface of such foot for enabling such foot to slide easily along a floor.

OBJECTS OF THE INVENTION

It is, therefore, one of the primary objects of the present invention to provide a combination cover and sliding device for furniture feet that is both decorative and useful.

Another object of the present invention is to provide a device to enable a user to easily move furniture.

Still another object of the present invention is to provide a device that will enable a user to move furniture without damaging flooring and carpet that sits beneath such furniture.

Yet another object of the present invention is to provide an inexpensive yet attractive device that will enable a user to easily move furniture.

An additional object of the present invention is to provide a device to enable a user to easily move furniture, such device being attractive and decorative such that a user might desire to simply leave the device engaged to such furniture at all times.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
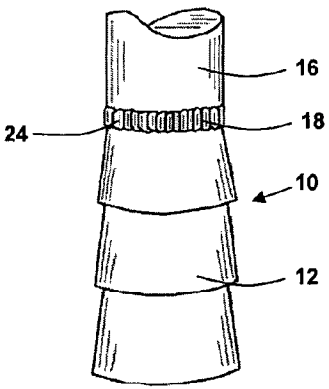
FIG. 1 is a partial perspective view of the invention according to a first embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
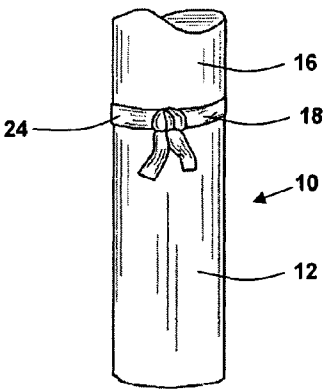
FIG. 2 is a partial perspective view of the invention according to a second embodiment of the invention.
Figure 3:
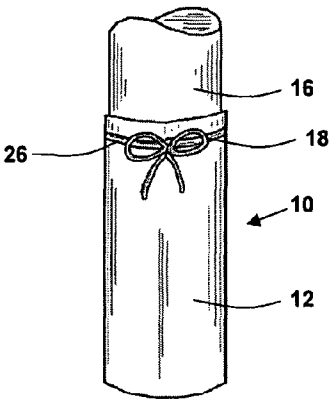
FIG. 3 is a partial perspective view of a part of the invention according to a third embodiment of the invention.
Figure 4:
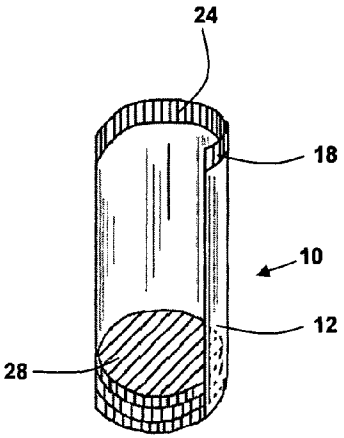
FIG. 4 is a partial perspective view of a part of the invention according to another embodiment of the invention.
Figure 5:
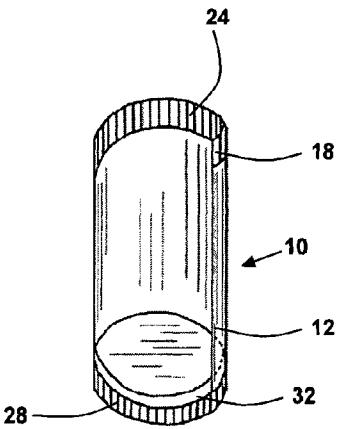
FIG. 5 is a partial perspective view of a part of the invention according to another embodiment of the invention.

Reference is now made, more particularly, to FIGS. 1-5. A combination furniture foot cover and sliding device, generally designated 10, is provided. Such combination furniture foot cover and sliding device 10 includes a housing member 12 for covering a foot (not shown) of a piece of furniture 16.

Such housing member 12 is manufactured from a first predetermined material and has a predetermined size and a predetermined shape. It is presently preferred that such first predetermined material is elastomeric. It is further presently preferred that such first predetermined material is selected from the group consisting of spandex, nylon, cotton, and felt. It is also presently preferred that such housing member 12 is manufactured in a variety of styles, colors, designs, and materials.

It is presently preferred that such predetermined shape is tube shaped.

A securing means 18 is operably connected to such housing member 12 for securing such housing member 12 to such foot. It is presently preferred that such securing means 18 is at least one of a ribbon 22, elastic bands 24, and string 26.

At least one layer 28 of a second predetermined material is operably connected to such housing member 12 and securable with a bottom surface 30 of such foot for enabling such foot to slide easily along a floor. It is presently preferred that such at least one layer of a second predetermined material is felt. It is presently most preferred that such at least one layer of a second predetermined material is formed from plastic.

In another embodiment of the invention such housing member 12 includes at least one reinforcement layer 32 within such housing 12 at a predetermined location for cushioning and supporting such foot and reinforcing such housing member 12 below such foot.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A combination furniture foot cover and sliding device comprising:

a. a housing member for covering a foot of a piece of furniture, said housing member being manufactured from a first predetermined material and having a predetermined size and a predetermined shape;

b. a securing means disposed at or adjacent to an upper edge of said housing member for securing such housing member to such foot;

c. at least one layer of a second predetermined material operably connected to said housing member disposed below a bottom surface of such foot, enabling such foot to slide easily along a floor;

d. at least one reinforced layer connected to said housing member having a first surface engageable with a bottom surface of such foot and a second surface engageable with an upper surface of said at least one layer of a second predetermined material, wherein a size of said at least one layer in a plane being normal to a length of said housing is substantially equal to a size of said at least one reinforced layer in said plane being normal to said length of said housing, wherein said predetermined shape of said housing is a generally tubular shape and wherein diameter of said at least one layer is substantially equal to diameter of said tubular shape, and wherein said first predetermined material is selected from the group consisting of spandex, nylon, cotton, and felt.

2. The combination furniture foot cover and sliding device of claim 1, wherein said securing means includes an elastic band disposed at an upper edge of said housing member when said housing member is installed for covering the furniture foot.

3. The combination furniture foot cover and sliding device according to claim 1, wherein said securing means being at least one of a ribbon, elastic bands, and string.

4. The combination furniture foot cover and sliding device according to claim 1, wherein said second predetermined material is plastic.

5. The combination furniture foot cover and sliding device according to claim 1, wherein said second predetermined material is felt.

6. The combination furniture foot cover and sliding device according to claim 1, wherein said housing member includes at least one reinforcement layer within said housing member at a predetermined location thereof for cushioning and supporting the foot and reinforcing said housing member below the foot.

7. A combination furniture foot cover and sliding device comprising:

a. a housing member for covering a foot of a piece of furniture, said housing member being manufactured from a first predetermined material and having a predetermined size and a generally tubular shape;

b. an elastic band disposed at an upper edge of said housing member when said housing member is installed for covering such foot;

c. at least one layer of a second predetermined material operably connected to said housing member disposed below a bottom surface of such foot, enabling such foot to slide easily along a floor;

d. at least one reinforced layer connected to said housing member having a first surface engageable with a bottom surface of such foot and a second surface engageable with an upper surface of said at least one layer of a second predetermined material, wherein a size of said at least one layer in a plane being normal to a length of said housing is substantially equal to a size of said at least one reinforced layer in said plane being normal to said length of said housing, wherein said predetermined shape of said housing is a generally tubular shape and wherein diameter of said at least one layer is substantially equal to diameter of said tubular shape, and wherein said at least one layer of a second predetermined material is felt.

8. A combination furniture foot cover and sliding device comprising:

a. a flexible housing member for covering a foot of a piece of furniture, said housing member being manufactured from a first predetermined material and having a predetermined size and a predetermined shape;

b. a securing means operably connected to said housing member at or adjacent to an upper edge thereof and securing said housing member in direct contact to said foot;

c. at least one flexible layer of a second predetermined material operably connected to said housing member, disposed below a bottom surface of such foot, said at least one layer of a second predetermined material being exposed for direct contact with a floor, enabling said foot to slide easily along said floor; and d. at least one flexible reinforced layer connected to said housing member having a first surface engageable with a bottom surface of such foot and a second surface engageable with an upper surface of said at least one layer of a second predetermined material, wherein a size of said at least one layer in a plane being normal to a length of said housing is substantially equal to a size of said at least one reinforced layer in said plane being normal to said length of said housing, wherein said predetermined shape of said housing is a generally tubular shape and wherein diameter of said at least one layer is substantially equal to diameter of said tubular shape, and wherein said first predetermined material is selected from the group consisting of spandex, nylon, cotton, and felt.

* * * * *